United States Patent [19]

Harris et al.

[11] Patent Number: 4,653,036

[45] Date of Patent: Mar. 24, 1987

[54] TRANSDUCER HYDROPHONE WITH FILLED RESERVOIR

[75] Inventors: Gerald R. Harris, Rockville; Aime S. DeReggi, Boyds, both of Md.

[73] Assignee: The United States of America as represented by the Department of Health and Human Services, Washington, D.C.

[21] Appl. No.: 663,969

[22] Filed: Oct. 23, 1984

[51] Int. Cl.[4] ..... H04R 17/00

[52] U.S. Cl. ..... 367/170; 310/800; 367/163

[58] Field of Search ..... 310/800, 327; 367/170, 367/164, 157, 180, 163, 165

[56] References Cited

U.S. PATENT DOCUMENTS

| | | | |
|---|---|---|---|
| 2,163,650 | 6/1939 | Weaver | 367/166 |
| 2,417,426 | 3/1947 | Mason | 367/165 |
| 2,468,537 | 4/1949 | Benoff | 367/163 |
| 2,797,399 | 6/1957 | Camp et al. | 367/163 |
| 3,368,193 | 2/1968 | McQuitty et al. | 367/157 |
| 3,894,169 | 7/1975 | Miller | 367/157 |
| 4,081,786 | 3/1978 | Richard | 367/166 |
| 4,178,577 | 12/1979 | Chi et al. | 367/170 |
| 4,433,400 | 2/1984 | DeReggi et al. | 367/170 |
| 4,517,665 | 5/1985 | DeReggi et al. | 367/170 |

*Primary Examiner*—Thomas H. Tarcza
*Assistant Examiner*—Ian J. Lobo
*Attorney, Agent, or Firm*—Browdy and Neimark

[57] ABSTRACT

A hydrophone device with one or more very small active spots located on a large continuous ferroelectric sheet, such as PVDF, overcomes many of the problems in prior art constructions associated with the high dielectric constant of various media in which the device is used. Additional improvements include increased signal to noise ratio and a sensitivity independent of the medium properties. The hydrophone device includes a piezoelectrically active sheet stretched and clamped on over the top of a hoop ring. A backing is attached to the back of the hoop ring. A low-dielectric material fills the space between the backing and the sheet. This material eliminates the capacitive loading effect which would otherwise be presented by the medium being probed.

18 Claims, 6 Drawing Figures

TRANSDUCER HYDROPHONE WITH FILLED RESERVOIR

FIELD OF INVENTION

This invention relates generally to ultrasonic hydrophone probes and more specifically to ultrasonic hydrophone probes employing a piezoelectrically active polymeric sheet as the active element.

BACKGROUND OF THE INVENTION

The first probing of ultrasonic fields in liquid involved in the use of miniature hydrophones consisting typically of a small crystalline or ceramic piezoelectrically active element, which was mounted together with suitable backing at the end of a tube or needle or other similar supporting structure. Despite their small size, such hydropohones unavoidably altered the acoustic field at the probed point because of the large difference in acoustic impedance between the hydrophone materials and the liquid medium in which the hydrophone was immersed during use. Furthermore, material and geometric factors of the sensing element and supporting structure led to multimode response, undesirable reflections and a complicated frequency and angle dependence of the response.

These problems were overcome to a great extent by replacing the ceramic active element with the piezoelectric polymer polyvinylidene fluoride (PVDF). However, in the needle-like geometry, non-uniformities in the frequency response still occurred because of the presence of the hydrophone housing.

To further improve the performance of polymer hydrophones, the spot-poled membrane design was developed, as shown in U.S. Pat. No. 4,433,400. In this design a single sheet of polymer film takes the form of a flat membrane held taut by means of a hoop or other convenient supporting structure which is made sufficiently large so as to remain, during use, outside the region of the medium sustaining acoustic wave fields and adequately far away from the field point probed. Typically the electrodes have the form of circular spots and the electrical leads have the form of fine lines. Multiple-element arrays also are possible. In cases when the acoustic field is confined within a collimated beam, the probe is oriented so that the membrane is perpendicular to the beam. Because the supporting structure is outside the beam, there are no significant reflections, and there is no significant response from unwanted modes. In particular, the response to normally incident plane wave fields is essentially independent of frequency below the thickness resonance frequency of the polymer membrane, which makes this design useful as a standard hydrophone against which the frequency response of other hydrophones can be compared.

Although this design is better than previous ones, it is not without certain problems and limitations. In particular, it suffers from the following deficiences:

a. Because the leads on the membrane are exposed, the hydrophone cannot be used to probe acoustic fields in electrically conductive fluids. For example, use in isotonic saline or similar biological fluids is prohibited because of the electrical shunting effect of these fluids.

b. The hydrophone sensitivity is dependent on the dielectric constant of the ultrasound propagation liquid surrounding the hydrophone. Thus no single hydrophone calibration factor can be specified; the probe must be recalibrated each time the dielectric properties of the surrounding liquid change.

c. For use in water or acoustically water-like media (the most common application), the large relative dielectric constant of the water (=80) surrounding the membrane lead causes the following problems:

(i) Significant reduction in hydrophone sensitivity occurs because of the electrical capacitance loading effect of the underwater leads.

(ii) The increased lead capacitances causes degradation of performance (i.e., increased noise voltage and decreased frequency response) when charge amplifiers are used to amplify the hydrophone signal.

(iii) The increased lead capacitance, as well as the mutual capacitance between elements, increases electrical crosstalk when multiple element hydrophone arrays are used.

d. Signal-to-noise level is degraded because of the susceptibility of the exposed electrical leads to radio frequency interference (RFI) pick-up.

e. The hydrophone directional response pattern can have an undesirably large side lobe structure due to the fact that the membrane geometry is capable of supporting surface waves.

f. The exposed electrical leads on the membrane are unprotected. This makes them highly susceptible to damage, which limits their usefulness outside of a laboratory setting and discourages commercial development and promotion of the hydrophone.

OBJECTS OF THE INVENTION

It is accordingly an object of this invention to overcome the disadvantages of prior art, such as indicated above; and a further object is to provide for improved ultrasound probing.

It is another object of this invention to provide an ultrasonic hydrophone which may be used to probe electrically conductive fluids.

It is a yet further object of this invention to provide an ultrasonic hydrophone having a sensitivity which is independent of the dielectric constant of the ultrasonic propagation liquid surrounding the hydrophone.

It is yet another object of this invention to provide an ultrasonic hydrophone which effectively reduces the electrical capacitance loading effect of the medium surrounding the hydrophone.

SUMMARY OF THE INVENTION

These and other objects are achieved by employing an acoustically-matched, low dielectric constant material-filled reservoir on the rear surface of a piezoelectrically active sheet material.

The subject invention eliminates or substantially reduces all of the above problems in the prior art constructions. Specifically, the present hydrophone design results in the following improvements:

(1) The material used to fill the reservoir formed by the polymer membrane and support rings prevents direct contact by electrically conductive fluids. Thus item "a." above is corrected.

(2) This "filled reservoir" design makes it possible to electrically shield the hydrophone by metal coating the outside surfaces. Thus the sensitivity is made independent of the electrical properties of the surrounding fluid medium (item "b." above), and the hydrophone is protected from RFI fields (item "d").

(3) The dielectric properties of the material filling the reservoir result in a dramatic reduction in the lead capacitance, so item "c" above is mitigated. In particular, the sensitivity enchancing property of the subject invention is significant, because it allows hydrophone sensitive elements of smaller size, and thus improved spatial resolution, to be realized. (For hydrophones used in biomedical ultrasonics, active element dimensions should be no greater than 1 mm, and preferably they should be 0.5 mm or less.)

(4) The surface waves that give rise to the anomalous directional response pattern are attenuated by the damping nature of the backing material filling the membrane supports hoops reservoir (item "e.")

(5) The hydrophone is much more rugged and robust (item "f.").

DETAILED DESCRIPTION OF THE PREFERRED EMBODIMENTS

Figure 1:
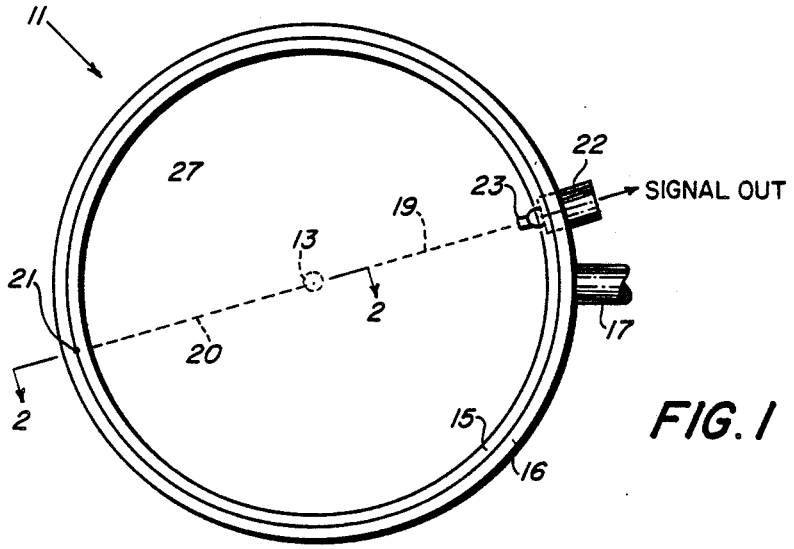
FIG. 1 is a top view of one embodiment of the hydrophone of the present invention.
Figure 2:
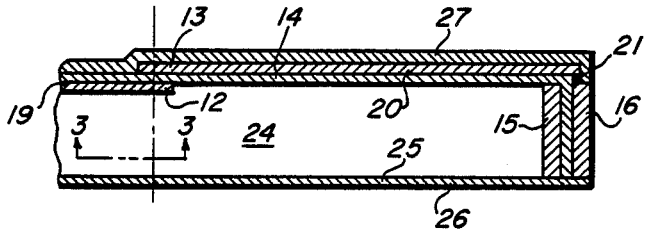
FIG. 2 is a cross-section of the hydrophone of FIG. 1, taken along line 2—2.
Figure 3:
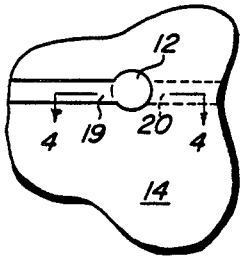
FIG. 3 is a cross-section of the hydrophone of FIG. 1, taken along line 3—3.

The subject invention is a high sensitivity, low noise hydrophone probe of robust design that can measure the spatial distribution (with high resolution) and the temporal variation (over a broad bandwidth extending to about 200 MHz) of the acoustic pressure in a fluid medium such as water, saline, oil, or biological tissue, without significantly altering the acoustic pressure at the point probed. The non-perturbing property is achieved by making the sensitive part of the probe an integral, small, central part of a large continous sheet of a semicrystalline piezoelectric polymer such as polyvinylidene fluoride (PVDF), or copolymers of vinylidene with tetrafluoraethylene or trifluoroethylene, the acoustic impedance of which is similar to that of the medium in which the probe is immersed. Electrodes on both sides of the sensitive part and electrical leads from the sensitive part to a suitable amplifier or transmission line away from the probed region are provided either by thin metallic coatings deposited on both sides of the polymer film or by fine metal wires bonded to the film surface using electrically conductive epoxy. The high sensitivity and low noise are achieved without sacrificing the non-perturbing property of the hydrophone by backing the polymer sheet with a material that posesses specific electrical, mechanical, chemical, and acoustic properties, as described below.

In one embodiment of the subject invention (see FIGS. 1-4), the hydrophone 11 consists of a single circular sheet of PVDF 25 micrometers thick with an electrode pattern deposited on each side. This pattern comprises the small circular electrodes 12, 13, both located centrally but on opposite sides of the piezoelectric sheet, shown at 14. The sheet 14 is clamped between inner and outer relatively rigid hoop rings 15 and 16 and held taut thereby. A radially extending supporting rod 17 is rigidly secured to the outer hoop ring 16.

Figure 4:
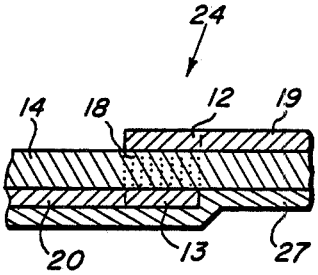
FIG. 4 is a cross-section of the hydrophone of FIG. 1, taken along line 4—4.

The electrodes 12, 13 define the piezoelectrically active region of the polymer film, shown at 18 (dotted region) in FIG. 4. Electrodes 12, 13 have respectively integrally deposited electrical leads 19,20 for transmission of the piezoelectrically-generated electrical signal. The outer (front) electrode 13 and lead 20 are connected electrically to the hoop ring 16 at 21. Coaxial connector 22 is attached to the hoop rings so that its outer (ground) conductor is connected electrically to hoop rings 15 and 16, lead 20, and electrode 13. The inner (rear electrode 12 and lead 19 are connected to the inner conductor 23 of the coaxial connector. If desired, a preamplifier can be interposed between 19 and 23.

The hoop rings 15 and 16 along with the polymer sheet 14 form a reservoir that is filled with a dielectric-/acoustic matching material 24. The selection of the properties of this material is critical. First, the volume resistivity must be large (greater than about $10^{14}$ ohm-cm), the relative dielectric constant must be low (less than about 4), the viscosity during filling must be low (less than about 30 poise), and the acoustic impedance (which is equal to the product of the density of and the speed of sound in the material) must match very closely that of the medium sustaining the acoustic waves. For the most common measurement media (water, oil, saline, tissue), the acoustic impedance is about $1.5\times10^6$ kg $m^{-2}s^{-1}$. Also, if a two-component material is selected, it must be able to cure at room temperature, since higher temperatures could partially depolarize the piezoelectrically sensitive region 18. There are many materials whose electrical properties would be acceptable, but whose acoustic properties would cause significant perturbation of the acoustic field. Two suitable materials that possess the required properties (unpublished measurements) are the silicone elastomer Sylgard 170 (Dow Corning), an encapsulant for electrical components, and the perfluorinated liquid Fluorinert FC-70 (3M), an electronic testing liquid.

The back surface 25 of the hydrophone is covered with an electrically conductive layer 26 which is electrically connected to hoop rings 15 and 16. If the perfluorinated liquid is used for 24, then a thin metal plate or metal-coated plastic could be used for the layer 26, thereby forming a closed container to hold the perfluorinated liquid. If the silicone elastomer is used for 24, then an electrically conductive pain could be used for the layer 26 as well.

The depth of the container determines the path length for the acoustic wave in the dielectric/acoustic matching material. If it is desired to prevent reflections from the back face 26 from reaching sensitive region 18 during the measurement time interval, the following measures or combinations thereof could be taken.

(1) Choose a depth consistent with the speed of sound in the material so that the reflected wave reaches the sensitive region after the measurement time interval.

(2) Choose a depth consistent with the acoustic attenuation of the material to attain a desired decrease in the amplitude of the reflected wave.

(3) Choose the thickness of 26 to be small compared to the wavelength of the measure acoustic wave so that 26 is esssentially acoustically transparent.

(4) Choose the shape of the surface 26 such that it will divert any reflected acoustic waves away from 18.

Next, the front face of the hydrophone is coated with an electrically conductive layer 27 either by metal vapor deposition or by conductive paint. If metal vapor deposition is used on the front face, excessive heating of the polymer film must be avoided; otherwise depolarization of the sensitive element 18 can result. This heating can be prevented by refrigerating the hydrophone immediately prior to the metal vapor deposition, thereby providing a cool thermal mass (i.e., the dielectric/acoustic matching material 24) next to the polymer film. If conductive paint is used as the front face layer 27, it must be applied in a thickness less than about 0.1 millimeter in order to minimize absorption of the acoustic waves impinging on the sensitive area 18.

The diameter of the active region 18 may be approximately 0.5 mm. The thicknesses of the deposited electrodes and leads, respectively 12, 13 and 19,20, and the final front face deposition 27, may consist of 0.2 micrometers of gold on 0.02 micrometers of chromium. This combination forms a highly stable electrode in water, saline, oil, and tissue. Nickel or aluminum can be used alternatively as deposited materials, but remetallization may be necessary with use.

The electrodes 12, 13 and their leads 19, 20 may be deposited on the polymer sheet 14 by vacuum evaporation from a tungsten filament through a metallic mask. To insure good edge definition of the electrodes and leads, the mask may be of iron foil so that when used with a magnetic substrate, with the polymer to be coated in between, it is attached magneticaly to the substrate and pressed tightly against the polymer. The electrode pattern may be produced in the mask photolithographically.

The hoop rings 15, 16 may be machined of brass or stainless steel to dimensions such that the diametric clearance between the inside and outside hoops is equal to the thickness of the membrane 14.

The active region 18 is rendered strongly piezoelectric by a poling process involving the temporary application of a voltage across the electrodes, which have been previously deposited on the opposite surfaces of the polymer film or sheet. A typical poling procedure consists of maintaining a nominal applied field of 1 MV/cm while the polymer is brought to a temperature of 100° C. for 30 minutes and then is brought back to room temperature. It is possible to prepare a sheet with significant piezoelectric activity confined within one or more very small areas, defined by the electrode pattern.

Figure 5:
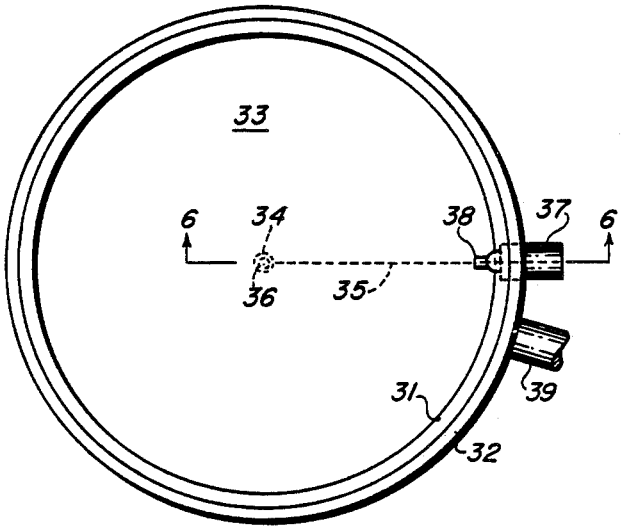
FIG. 5 is a top view of another embodiment of the present invention.
Figure 6:
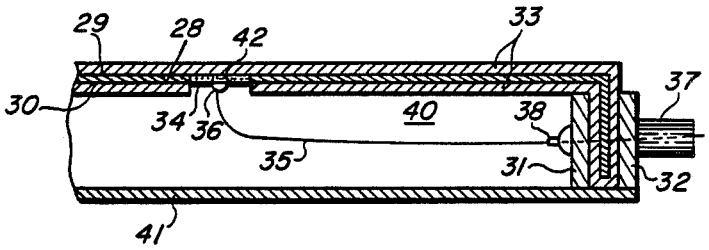
FIG. 6 is a partial cross-section of the hydrophone of FIG. 5, taken along line 6—6. The coaxial connector is not shown in cross-section.

FIGS. 5 and 6 illustrate a second embodiment in which several modifications have been made. First, the polymer sheet 28 is completely polarized and is thus piezoelectrically active over its entire surface, and not just at one central spot. Second, the front and rear surfaces, respectively 29 and 30, of the polymer sheet are metal-coated and electrically connected together as well as electrically connected to the hoop rings 31, 32. This contiguous coating is shown as 33. Such a connection of front and rear surface coatings effectively neutralizes the piezoelectric activity of the polymer sheet, except over a central portion of the sheet described next. Third, a central portion of the metal coating on the rear side 30 of the polymer sheet is abraded or etched to expose a small circular region 34 on the polymer surface. Fourth, a fine (smaller than about 0.002 inch) diameter wire 35 is connected to this exposed spot using a small bead of conductive epoxy 36. This wire then becomes the rear lead, which is connected to the inner conductor of the coaxial connector 37 at 38, and which is equivalent to 19 in FIGS. 1–4. The connection of the coaxial connector 37 outer (ground) conductor to the hoop ring 32, and the treatment of the dielectric/acoustic material 40 and back face coating 41 are the same as in previous embodiment shown in FIGS. 1, 2 and 4.

The size of the region 34 determines the size of the active region, shown as 42 (dotted region) in FIG. 6. The diameter of the region 34 may be approximately 0.5 millimeters. The diameter of the bead 36 must be less than the diameter of region 34 so that the inner lead 35 and the ground coating 33 will be isolated electrically from each other.

This embodiment has the advantage of simplicity in that commercially available poled and metal-coated film can be used, and the metal vapor deposition and spot poling procedures can be avoided. The wire 35 and epoxy bead 36 do consitute potentially hard acoustic discontinuities in the acoustic field, but because of their small size, the non-perturbing properties and performance of this embodiment are still excellent.

The piezoelectrically active polymer sheet should be of a thickness such that it is substantially acoustically transparent in a liquid. A typical thickness might be less than about 25 micrometers. The size and location of the piezoelectrically active area should be chosen in all embodiments so that both hoops remain outside of the region of the medium subjected to the acoustic energy and the point being probed by the hydrophone device.

Other details relevant to this invention, and hydrophone construction in general, may be found in U.S. Pat. No. 4,433,400, incorporated herein by reference.

The present invention is intended to cover other methods of mounting the polymer sheet in form of a taut membrane. It is also intended to cover patterns deposited on the polymer sheet forming multiple-element hydrophones, such as arrays of points, or arrays of parallel line elements, of arrays of annular elements, or other planar arrays.

While certain specific embodiments of improved hydrophone probes have been disclosed in the foregoing description, it will be understood that various modifications within the scope of the invention may occur to those skilled in the art. Therefore, it is intended that adaptions and modifications should and are intended to be comprehended within the scope of the appended claims.

What is claimed is:

1. A hydrophone device for use in probing the acoustic properties of a fluid medium, comprising:

supporting hoop means of a selected area;

first sheet means of biaxially oriented polymer material secured in said hoop means and held thereby in a taut condition;

means having a poled piezoelectrically active area of predetermined size, the selected area of said first sheet means defined by said hoop means being larger than the size of said poled piezoelectrically active area, and said poled piezoelectrically active area being located in said first sheet means and spaced from said hoop means such that said hoop means during use remains outside, and said poled piezoelectrically active area remains inside, the region of the medium subjected to the acoustic energy and the point being probed by said hydrophone device, said sheet means having respective outer and inner electrode means of electrically conductive material on opposite outer and inner surfaces of said poled piezoelectrically active area, said first sheet means having a thickness selected such that it is substantially acoustically transparent in said fluid medium, and first and second electrical leads on said first sheet means, electrically connected to said inner and outer electrode means, respectively, and extending toward the periphery of said first sheet means, said second electrical lead electrically connected to said hoop means, said hoop means connected to an outer conductor of a coaxial connector, said first electrical lead electrically connected to an inner conductor of said coaxial connector;

an electrically conductive coating on the entire outer surface of said first sheet means, and in electrical contact with said hoop means;

a reservoir defined by the inner surface of said first sheet means, said hoop means, and an electrically conductive backing means secured to and electrically connected to said hoop means and spaced from the inner surface of said first sheet means, said reservoir being filled by a low-dielectric constant material having an acoustic impedance which is about equal to that of said medium, a dielectric constant of less than about 4 and a volume resistivity of greater than about $10^{14}$ ohm-cm.

2. The hydrophone of claim 1, wherein said medium is water, oil, saline or tissue and said lowdielectric constant material is a silicone elastomer of a perfluorinated liquid having an acoustic impedance which is about equal to that of said medium, a dielectric constant of less than about 4 and a volume resistivity of greater than about $10^{14}$ ohm-cm.

3. The hydrophone of claim 1 wherein said piezoelectrically active area is defined by a poled point smaller than said first piezoelectric sheet, said inner and outer electrode means being deposited on said point and said first and second electrode leads comprising metal deposited on said first sheet means.

4. The hydrophone device of claim 3 wherein said deposited electrode means and electrical leads comprise metal films which are approximately 0.2 micrometers in thickness.

5. The hydrophone device of claim 1, and wherein said poled piezoelectric area is approximately 0.5 mm in diameter.

6. The hydrophone device of claim 1, and wherein said first sheet means comprises semicrystalline polymer sheet material of the group comprising polyvinylidene fluoride and copolymers of vinylidene fluoride with tetrafluoroethylene or trifluoroethylene.

7. The hydrophone device of claim 1, and wherein said poled piezoelectric area is located substantially centrally of said first sheet means.

8. The hydrophone device of claim 7, wherein said first sheet means is approximately 25 micrometers in thickness.

9. The hydrophone device of claim 1, and wherein said hoop means comprise inner and outer relatively rigid hoop rings clampingly securing said sheet means therebetween.

10. The hydrophone of claim 1, wherein said first sheet means is poled over its entire surface, and has electrically conductive metal deposited over the entire inner surface thereof, except for one small region, said metal over said inner surface is in electrical contact with said hoop means and said conductive coating on said outer surface of said first sheet means, said inner electrode means comprises a bead of electrically conductive epoxy on said small region, said bead having a diameter smaller than that of said small region and being electrically isolated from said electrically conductive metal deposited on said inner surface of first said first sheet means, said first electrical lead comprises a wire electrically connected to said bead at one end and the inner conductor of said coaxial connector, and said second electrical lead and said outer electrode means comprise said electrically conductive coating on said outer surface of said first sheet means, and said poled piezoelectrically active area is defined by said small region.

11. The hydrophone of claim 10, wherein said medium is water, oil, saline or tissue an said low-dielectric material is a silicone elastomer or a perfluorinated liquid.

12. The hydrophone device of claim 10, and wherein said poled piezoelectrically active area is approximately 0.5 mm in diameter.

13. The hydrophone device of claim 10, and wherein said first sheet means comprises a semicrystalline polymer sheet material of the group comprising polyvinylidene fluoride and copolymers of vinylidene fluoride with tetrafluoroethylene or trifluoro ethylene.

14. The hydrophone device of claim 1, and wherein said poled piezoelectric area is located substantially centrally of said first sheet means.

15. The hydrophone device of claim 1, and wherein said each first sheet means is approximately 25 micrometers in thickness.

16. The hydrophone device of claim 1, and wherein said hoop means comprises inner and outer relatively rigid hoop rings clampingly securing said first sheet means therebetween.

17. The hydrophone device of claim 1 having an array of piezoelectrically active regions.

18. The hydrophone device of claim 1, wherein the acoustic impedance of said low-dielectric material is about $1.5(10^6)$ kg $m^{-2}s^{-1}$.

* * * * *